United States Patent [19]

Gonzalez

[11] 4,427,465

[45] Jan. 24, 1984

[54] EXPLOSIVE MIXTURE FOR BLASTING

[75] Inventor: Miguel M. Gonzalez, Havana, Cuba

[73] Assignee: Empress Cubana Importadora de Materias Primasy Productos, Vedado, Cuba

[21] Appl. No.: 281,729

[22] Filed: Jul. 9, 1981

[51] Int. Cl.[3] ..... C06B 45/00

[52] U.S. Cl. ..... 149/2; 149/60; 149/109.2

[58] Field of Search ..... 149/109.2, 109.4, 60, 149/2

[56] References Cited

U.S. PATENT DOCUMENTS 3,406,051 10/1968 Fearnow ..... 149/60 X

*Primary Examiner*—Stephen J. Lechert, Jr.

*Attorney, Agent, or Firm*—Lackenbach, Siegel, Marzullo, Presta & Aronson

[57] ABSTRACT

An explosive mixture of 70 to 99.5% by weight of ammonium nitrate and 0.5 to 30% by weight of final sugarcane syrup or sugar-beet syrup as the reducing agent.

5 Claims, No Drawings

EXPLOSIVE MIXTURE FOR BLASTING

BACKGROUND OF THE INVENTION

The invention relates to an explosive composition for use in blasting and its main field of application is in construction, mining and agriculture.

Various explosive mixtures are known to use ammonium nitrate as the main constitutent, examples being those appearing in the following publication: "Blaster's Handbook," Sixth Edition issued by Canadian Industries Limited, Explosives Division, Canada; "Swedish Blasting Technique," by Rune Gustafsson, Sweden; and "Powders and Explosives," by Dr. A. Stettbacher, Switzerland.

The prototype closest to the present invention is a composition called "AN-FO," patented in the United States in 1954 and consisting of a mixture of ammonium nitrate and fuel-oil or gas-oil; this is mentioned in various publications, among others in the Sixth Edition of the "Blasters' Handbook," by Canadian Industries Limited, Canada.

As compared with the closest prototype, i.e. AN-FO, the composition according to the invention has the advantage that the reducing agent used therein is cheaper and more stable. The product obtained is thus cheaper and more efficient.

It is the purpose of the invention to use this explosive mixture for general construction work, mining and agriculture, thus improving the safety and efficiency of work of this kind and providing maximal cost reduction.

SUMMARY OF THE INVENTION

The invention consists of a composition containing a mixture of between 70 and 99.5% of ammonium nitrate as the oxidizing agent, with 0.5 to 30% of final sugar-cane syrup or beet-sugar syrup, as the reducing agent. The composition has been given the trade name "NITROMIEL."

DETAILED DESCRIPTION

The mixture of ammonium nitrate and final sugar-cane syrup or beet-sugar syrup, in the proportions of 70–99.5% and 0.5 to 30%, respectively, is obtained in a mixer similar to those normally used in mixing "AN-FO" explosives or "slurries." Mixing times are between 5 and 30 minutes, depending upon the quantities to be mixed.

The ammonium nitrate used should be of the granulated type having a minimal nitrogen content of 34% and a minimal purity, or concentration, of 98.5%. The sugar-cane syrup or beet-sugar syrup should be in its normal physical condition, i.e. a viscous liquid having a density of between 1.3 and 1.5 g/cm$^3$.

The explosive mixture thus obtained has a density of between 0.96 and 1.05 g/cm$^3$, is slightly moist to the touch, light beige in color, and has a detonation-velocity of between 3000 and 4000 m/sec.

EXAMPLE 1

5 kg of the syrup and of the ammonium nitrate were placed in a mixer having a 10 kg capacity and mixing was carried out for between 5 and 20 minutes. The product obtained had a density of between 0.96 and 1.05 g/cm$^3$, was slightly moist to the touch, light beige in color, and had a detonation-velocity of between 3000 and 4000 m/sec. Chemical stability, safety in handling, and explosive efficiency were excellent.

EXAMPLE 2

300 kg of the syrup and of the ammonium nitrate were placed in a 350 kg mixer, and mixing was carried out for between 10 and 30 minutes; the characteristics of the product obtained were identical with those of the product in Example 1.

As regards technical-economic efficiency, this mixture has the advantage of using sugar-cane syrup or beet-sugar syrup as the reducing agent, these products being less expensive than any other reducing agent at present used in known explosive mixtures. Moreover, the physico-chemical stability thereof is superior to that of any known solution, as is its safety in manufacture and handling.

I claim:

1. An explosive composition consisting essentially of 0.5–30 percent by weight of a syrup selected from the group consisting of sugar-cane syrup and beet-sugar syrup and 70 to 99.5 percent of ammonium nitrate.

2. The composition of claim 1 consisting of 50 percent of the syrup and 50 percent of ammonium nitrate.

3. The composition of claim 1 wherein said syrup has a density of 1.3 to 1.5 g/cm$^3$.

4. The composition of claim 1 having a density between 0.96 and 1.05 g/cm$^3$.

5. The composition of claim 1 having a detonation velocity between 3000 and 4000 m/sec.

* * * * *